US007614268B2

(12) United States Patent
Preddey

(10) Patent No.: US 7,614,268 B2
(45) Date of Patent: Nov. 10, 2009

(54) ROTARY LOCK AND KEY

(75) Inventor: Brian Preddey, Gerringong (AU)

(73) Assignee: Camware Holdings Pty Ltd., Victoria (AU)

( * ) Notice: Subject to any disclaimer, the term of this patent is extended or adjusted under 35 U.S.C. 154(b) by 612 days.

(21) Appl. No.: 10/561,150

(22) PCT Filed: Jun. 11, 2004

(86) PCT No.: PCT/AU2004/000779

§ 371 (c)(1),
(2), (4) Date: Sep. 13, 2006

(87) PCT Pub. No.: WO2004/111369

PCT Pub. Date: Dec. 23, 2004

(65) Prior Publication Data

US 2007/0062230 A1 Mar. 22, 2007

(30) Foreign Application Priority Data

| | | |
|---|---|---|
| Jun. 16, 2003 | (AU) | 2003903029 |
| Feb. 9, 2004 | (AU) | 2004200498 |
| Mar. 8, 2004 | (NZ) | 531575 |

(51) Int. Cl.
*E05B 27/00* (2006.01)
*E05B 29/00* (2006.01)

(52) U.S. Cl. ..... 70/491; 70/337; 70/376; 70/392; 70/404

(58) Field of Classification Search ..... 70/337–343, 70/376, 377, 392, 403, 404, 407, 490, 491, 70/492

See application file for complete search history.

(56) References Cited

U.S. PATENT DOCUMENTS 2,431,894 A 12/1947 Spain (Continued)

FOREIGN PATENT DOCUMENTS

AU 632190 B2 5/1992

(Continued)

OTHER PUBLICATIONS

Matt Blaze, Cryptology and Physical Security: Rights Amplification in Master-Keyed Mechanical Locks, Journal: IEEE Security and Privacy, Mar./Apr. 2003, pp. 1-12.

*Primary Examiner*—Peter M Cuomo
*Assistant Examiner*—Christopher Boswell
(74) *Attorney, Agent, or Firm*—Novak Druce + Quigg LLP; Joseph W. Bain

(57) ABSTRACT

A cylinder lock is provided. The lock includes a rotor assembly (17) having a combination post (12) as a core. The combination post (12) has combination holes arranged thereon which define the combination of the lock. The rotor assembly (17) includes locking bars having pins (15) directed radially towards the combination post (12). The locking bars are displaceable in an axial position by an appropriately coded key until each pin (15) is directed towards a respective combination hole. Turning the key causes the rotor assembly (17) to rotate. At various rotational positions, the locking bars are displaced radially causing the pins (15) to engage their respective combination holes. The combination post (12) can be provided with parallel combination holes. Furthermore, the combination post (12) can be removable in order to replace the combination post (12) with another post having different combination values, thereby changing the combination of the lock.

56 Claims, 7 Drawing Sheets

U.S. PATENT DOCUMENTS

| | | | | | |
|---|---|---|---|---|---|
| 3,008,322 | A | | 11/1961 | Stackhouse | |
| 3,404,548 | A | * | 10/1968 | Keefer | 70/491 |
| 3,648,492 | A | * | 3/1972 | Walters et al. | 70/491 |
| 3,667,264 | A | | 6/1972 | Surko, Jr. et al. | |
| 3,713,310 | A | | 1/1973 | Surko, Jr. | |
| 3,728,880 | A | | 4/1973 | Falk | |
| 3,738,136 | A | | 6/1973 | Falk | |
| 3,776,008 | A | | 12/1973 | Schlage | |
| 3,890,815 | A | | 6/1975 | Raymond et al. | |
| 3,903,720 | A | | 9/1975 | Scherbing | |
| 3,938,359 | A | | 2/1976 | Millett et al. | |
| 3,992,907 | A | | 11/1976 | Pilvet | |
| 4,012,931 | A | * | 3/1977 | Harunari | 70/496 |
| 4,061,004 | A | | 12/1977 | Pappanikolaou | |
| 4,094,175 | A | | 6/1978 | Pechner | |
| 4,100,777 | A | | 7/1978 | Fredon | |
| 4,185,480 | A | | 1/1980 | Pechner | |
| 4,195,504 | A | | 4/1980 | Foshee | |
| 4,233,828 | A | | 11/1980 | Dauenbaugh | |
| 4,400,955 | A | | 8/1983 | Di Motta | |
| 4,409,807 | A | | 10/1983 | Lipschutz | |
| 4,412,437 | A | | 11/1983 | Smith | |
| 4,434,636 | A | | 3/1984 | Prunbauer | |
| 4,440,009 | A | | 4/1984 | Smith | |
| 4,446,709 | A | | 5/1984 | Steinbach | |
| 4,612,787 | A | | 9/1986 | Prunbauer et al. | |
| 4,622,834 | A | * | 11/1986 | Hughes | 70/395 |
| 4,624,119 | A | | 11/1986 | Newman et al. | |
| 4,638,651 | A | | 1/1987 | Surko, Jr. | |
| 4,648,252 | A | | 3/1987 | Dugan | |
| 4,653,297 | A | | 3/1987 | Moorhouse | |
| 4,669,288 | A | | 6/1987 | Percebois et al. | |
| 4,741,188 | A | | 5/1988 | Smith | |
| 4,747,281 | A | | 5/1988 | Monahan | |
| 4,765,163 | A | | 8/1988 | Trull et al. | |
| 4,836,002 | A | | 6/1989 | Monahan | |
| 4,966,021 | A | | 10/1990 | Boag | |
| 5,000,019 | A | | 3/1991 | Foster | |
| 5,018,376 | A | | 5/1991 | Lee | |
| 5,024,072 | A | | 6/1991 | Lee | |
| 5,168,734 | A | | 12/1992 | Duval et al. | |
| 5,351,514 | A | * | 10/1994 | Recio | 70/491 |
| 5,375,444 | A | | 12/1994 | Smith | |
| 5,402,660 | A | * | 4/1995 | Osada | 70/491 |
| 5,595,080 | A | | 1/1997 | Whinton | |
| 5,685,184 | A | | 11/1997 | Gallagher | |
| 5,718,136 | A | | 2/1998 | Aldieri et al. | |
| 5,775,146 | A | | 7/1998 | Edwards et al. | |
| 5,921,121 | A | | 7/1999 | Tang | |
| 5,934,121 | A | | 8/1999 | Chen | |
| 5,979,200 | A | | 11/1999 | Cliff | |
| 6,079,240 | A | | 6/2000 | Shvarts | |
| 6,145,356 | A | | 11/2000 | Thwing | |
| 6,155,090 | A | | 12/2000 | Rubensson | |
| 6,295,850 | B1 | | 10/2001 | Anderson | |
| 6,553,801 | B2 | | 4/2003 | Chen | |
| 6,644,078 | B1 | * | 11/2003 | Hung | 70/491 |
| 6,718,808 | B2 | * | 4/2004 | Yu | 70/491 |
| 7,150,168 | B1 | * | 12/2006 | Kuo | 70/491 |
| 7,162,900 | B1 | * | 1/2007 | Lu | 70/491 |
| 2003/0041630 | A1 | | 3/2003 | Laitala et al. | |
| 2004/0231379 | A1 | * | 11/2004 | Yu | 70/491 |

FOREIGN PATENT DOCUMENTS

| | | | |
|---|---|---|---|
| AU | 199869974 | B2 | 10/1998 |
| AU | 200019416 | A1 | 8/2001 |
| BE | 1010212 | A3 | 3/1998 |
| CH | 636669 | A5 | 6/1983 |
| EP | 0296337 | | 12/1988 |
| EP | 0410437 | | 1/1991 |
| EP | 0449177 | | 10/1991 |
| FR | 2 237 483 | | 2/1975 |
| FR | 2389742 | | 12/1978 |
| FR | 2406711 | A | 5/1979 |
| GB | 2 125 093 | A | 2/1984 |
| IT | 1242950 | | 5/1994 |
| JP | 8218691 | | 8/1996 |
| JP | 2002047834 | | 2/2002 |
| JP | 2002054327 | | 2/2002 |
| JP | 2002242498 | | 8/2002 |
| RU | 2119032 | C1 | 9/1998 |
| TW | 425451 | B | 3/2001 |
| WO | WO97/13944 | | 4/1997 |

* cited by examiner

ROTARY LOCK AND KEY

TECHNICAL FIELD

The present invention relates to an improved lock structure and keys and a method of improved master keying and of combination changing.

BACKGROUND ART

Lock structures, particularly in relation to high-security locks, have the tendency to involve increasingly complex mechanisms in order to achieve higher levels of security. A natural consequence of such complexity is that lock mechanisms involve more moving parts to achieve more combinations. In order to re-key a lock, whereby the combination of the lock is changed, it is necessary to disassemble the lock, adjust or replace the necessary components of the lock and then reassemble the lock. This process is very involved and time consuming, and requires the skills of a professional locksmith.

The robustness of locks is another consideration when providing locks in which the combination is to be changed regularly. This is often the case with high-security locks. Lock manufacturers have produced locks for this purpose in which only part of the lock structure is required to be removed and re-keyed in order to provide new combinations. Typically, it is the lock plug which is removed, re-keyed and then replaced. However, re-keying the lock plug still requires disassembly and reassembly of the lock plug and is still very much an involved and time consuming process. The procedure for removing and replacing such lock plugs is not simple. The lock must be designed so that the processes of removing and replacing the lock plug are relatively quick and efficient. The lock structure which is not to be removed and the removable part must both be able to withstand the removal and replacement procedures; any damage caused thereto could result in the entire lock having to be replaced. Care must be taken in ensuring that the removable part is correctly aligned so that it is in proper working engagement with the rest of the lock structure. This is not a trivial exercise and requires a high degree of precision. Regular changing of lock combinations can, therefore, add up to a costly and troublesome exercise. It has become desirable in the high-security lock industry to be able to offer master keying. Master keying involves a hierarchy of keys. The number of locks a key can open depends upon how high up the hierarchy the key is positioned. Typically the hierarchy consists of standard keys opening unique locks, master keys opening a number of locks, and a grandmaster key opening all or nearly all locks.

In a paper by Mr Matt Blaze, 'Cryptology and Physical Security: Rights Amplification in Master-Keyed Mechanical Locks', *IEEE Security and Privacy* (March/April 2003), the inherent problems associated with master keying were discussed. In summary, master keying actually reduces the number of possible combinations that can be applied to a lock. This reduces the security that such locks can offer. Where master keying has been implemented by profiling it has been noted that this may also reduce the strength of the key leading to operational difficulties.

Accordingly, it is an object of the present invention to provide a lock structure which offers a reasonable level of security and robustness.

It is a further preferred object of the present invention for such a lock to facilitate changing combinations in which a minimum number of moving parts are required to be replaced. The process for changing combinations is intended to be relatively simple in comparison with other locks.

It is a further object of the present invention to provide keys adapted for use with the inventive lock.

It is a further preferred object of the present invention to provide a lock which offers improved master keying potential, in which master keying does not substantially reduce the number of operational combinations which are available.

SUMMARY OF THE INVENTION

According to one aspect of the invention there is provided a cylinder lock, including:

a housing having a cylindrical bore therein;

a rotor assembly rotatably mounted within said bore;

a plurality of locking bars arranged on said rotor assembly, each locking bar including a locking bar pin directed radially inward towards the axis of said rotor assembly, wherein each locking bar is displaceable on the rotor assembly in a direction substantially parallel with said axis, and each locking bar is displaceable in a radial direction with respect to said axis; and a combination post arranged along said axis, said combination post having a plurality of combination holes formed thereon;

wherein each of said locking bars is adapted to be displaced by a coded key, in said substantially parallel direction, to a position in which the locking bar pin of each said locking bars is directed towards a respective combination hole, said rotor assembly is adapted to be rotated by said key to an unlocking position, wherein at various rotational positions each said locking bar is radially displaced towards said axis, thereby engaging each said locking bar pin with a respective combination hole, so as to permit rotation of said rotor assembly within said bore.

According to another aspect of the invention there is provided a cylinder lock, including:

a housing having a cylindrical bore therein;

a rotor assembly rotatably mounted within said bore; and a plurality of locking bars arranged on said rotor assembly, each locking bar including a locking bar pin directed radially inward towards the axis of said rotor assembly, wherein each locking bar is displaceable on the rotor assembly in a direction substantially parallel with said axis, and each locking bar is displaceable in a radial direction with respect to said axis;

said lock being adapted to accept a combination post arranged along said axis, said combination post having a plurality of combination holes formed thereon;

wherein each of said locking bars is adapted to be displaced by a coded key, in said substantially parallel direction, to a position in which the locking bar pin of each said locking bars is directed towards a respective combination hole; said rotor assembly is adapted to be rotated by said key to an unlocking position, wherein at various rotational positions each said locking bar is radially displaced towards said axis, thereby engaging each said locking bar pin with a respective combination hole, so as to permit rotation of said rotor assembly within said bore.

Preferably, the lock combination can be changed by replacing only the combination post. The positioning of combination holes on the combination post provides the lock combination. Thereby, replacing the combination post with another combination post having combination holes in different positions effectively changes the lock combination. In this way, the replacement procedure is relatively easy and involves a bare minimum of moving parts. The most intricate moving parts, being the locking bars, are not required to be replaced or adjusted.

According to another preferred aspect, the present invention relates to a key and combination post set, including one or more combination posts and one or more corresponding keys, such that if a lock is set to the combination defined by said post or posts, said key or keys can operate said lock.

Preferably, the lock provides selectable parallel combinations. This means that a lock may be operable by several keys, thereby offering master keying potential, but with the advantage of not reducing the number of combinations available.

According to another aspect, the present invention relates to a key for a cylinder lock, said lock including a housing having a cylindrical bore therein, and a rotor assembly mounted within said bore, said rotor assembly including locking bars disposed radially around said rotor, each of said locking bars being arranged to be displaced in a direction substantially parallel to the axis of said rotor, said key including a body with a cylindrical bore, and a set of radially disposed outward projections, said projections being operatively adapted to displace said locking bars.

In a preferred form, the key further includes means to engage a combination post of said lock and operatively rotate said post to a predefined rotational position.

The present invention further relates to a lock including a first component for setting the combination, and a second component arranged to release the lock, the first and second components being arranged to rotate relative to each other, and wherein there are multiple non-redundant relative rotational positions of the first and second components, at least a first one of said positions defining a normal combination, and a second position defining a master key combination.

The inventive arrangement allows for independent combinations for the lock to be provided at different rotational positions. This concept is not specific to the particular implementations disclosed. By taking this approach, the available normal operating combinations are not reduced by master keying.

BRIEF DESCRIPTION OF THE DRAWINGS

Preferred embodiments of the present invention will now be described with reference to the accompanying drawings.

DESCRIPTION

Figure 1:
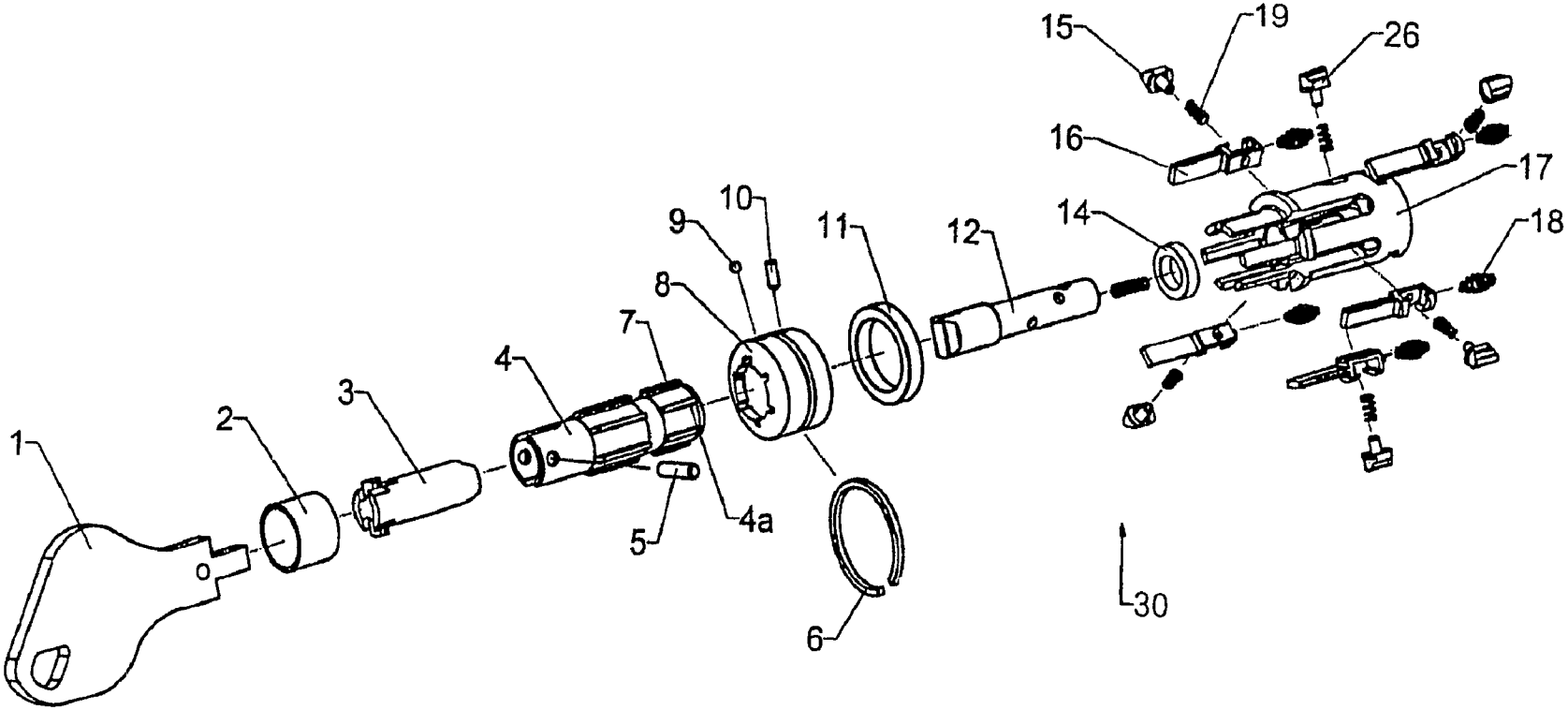
FIG. 1 is an exploded view of one preferred embodiment of a lock plug and key.
Figure 3:
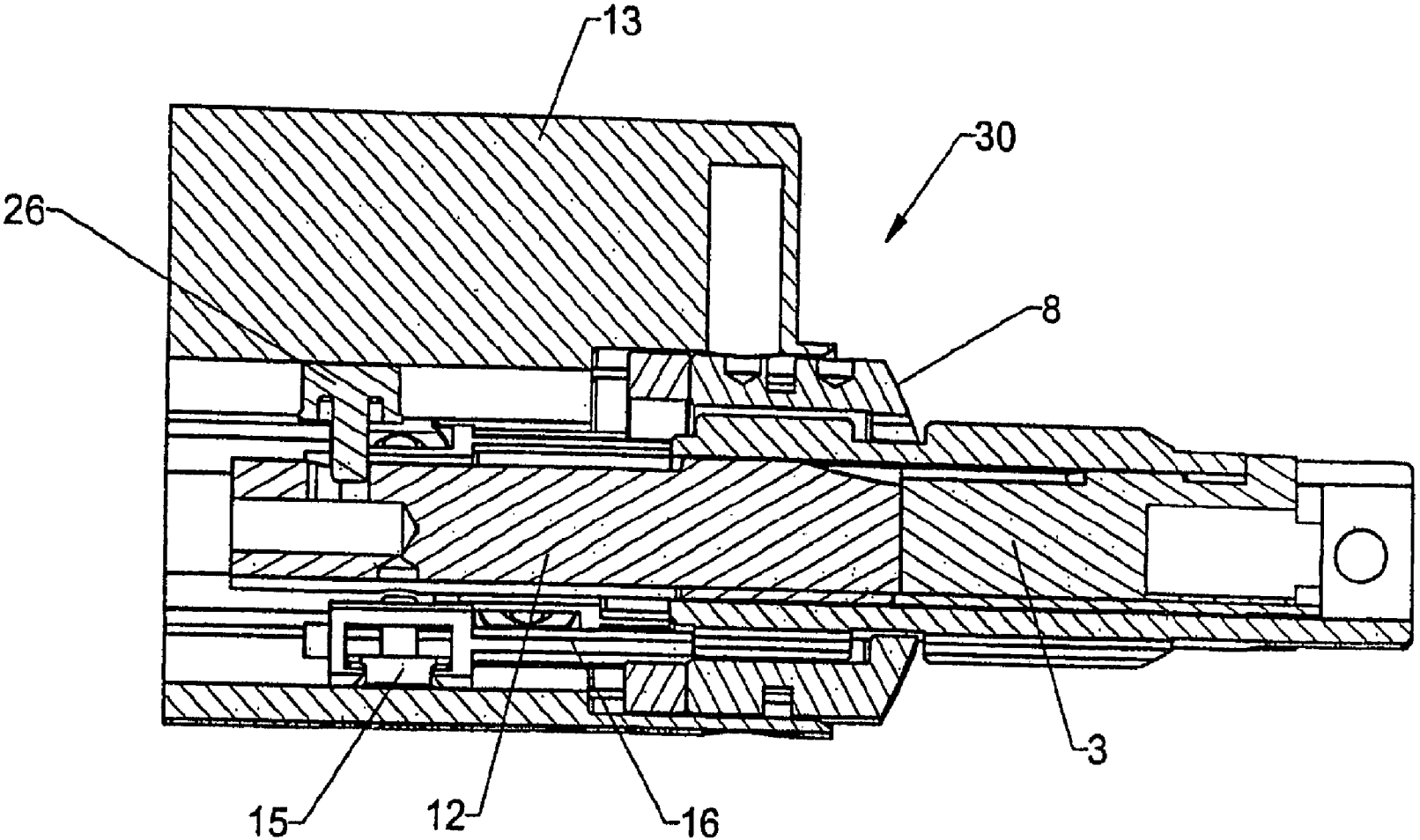
FIG. 3 is a cross-sectional view of the lock of FIG. 2 taken along lines A-A, the lock having a key inserted.

FIGS. 1 and 3 show a preferred embodiment of a lock structure, according to the invention, including a plug 30 and a shell 13.

The plug 30 includes a combination post 12, a face cap 8 and a rotor assembly 17.

The rotor assembly 17 receives the combination post 12 as a core. Around the circumference of the rotor assembly 17 are arranged guiding channels extending axially along part of the length of the rotor assembly 17. Each guiding channel receives a locking bar arranged to slide along the length of the guiding channel. Each locking bar is biased by a spring 18 towards the face cap 8. Each guiding channel further includes a slot along part of the length of the channel. The slot provides access to the combination post 12 from the guiding channel.

The locking bars include a carriage 16 and a head member 15. The head member is arranged with a locking bar pin directed radially towards the combination post 12, and is biased by spring 19 in a direction radially away from the combination post 12.

The face cap 8 includes a keyway, a retainer clip 6, a retainer pin 10 and a face cap location, ball 9. The face cap location ball 9 and retainer pin 10 secures the position of the face cap 8 relative to the shell 13.

An anti-drill plate 11 is provided between the face cap 8 and the locking bars as an anti-tampering measure to prevent access to the locking bars from the face cap 8. A further anti-drill ring 14 is provided to prevent access to the surface of the combination post 12.

Figure 4B:
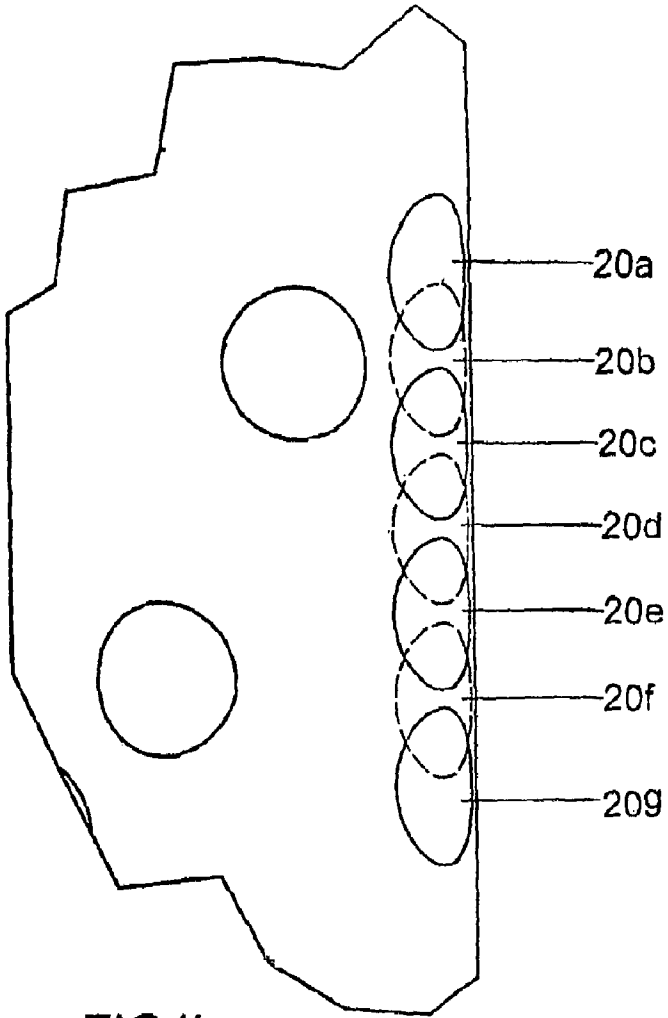
FIG. 4*b* is a close-up view of section B of FIG. 4*a;*
Figure 4A:
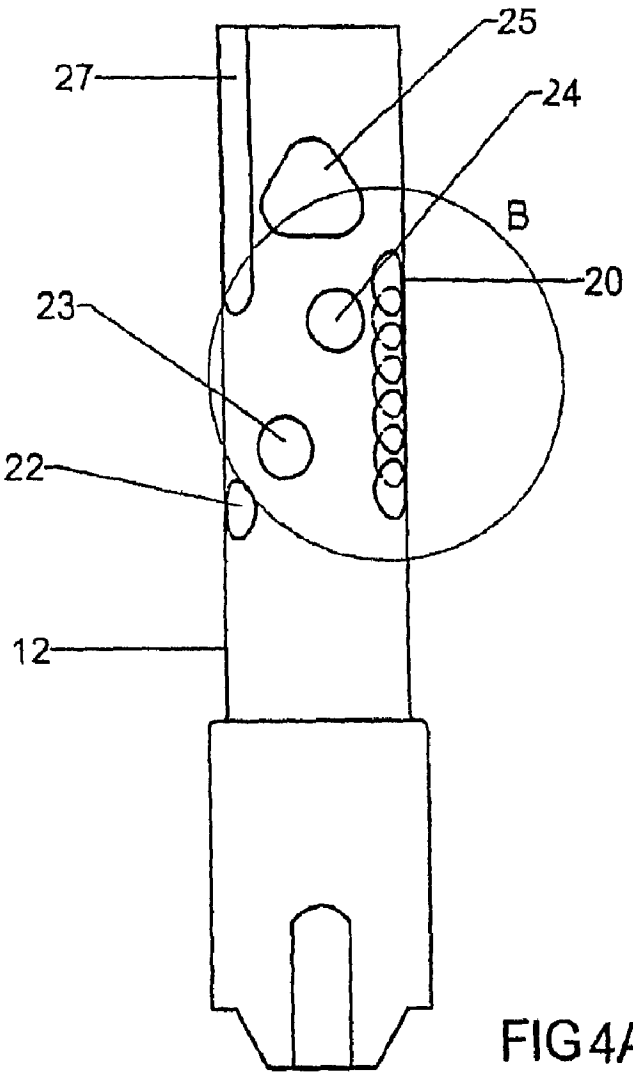
FIG. 4*a* is a view of a combination post.

The combination post 12 includes a plurality of combination holes on its surface providing combination values for the lock. The number of combination holes is generally equal to the number of locking bars provided. The combination holes are arranged at angular positions around the circumference of the combination post 12 so that at least one combination hole is accessible via each slot of the guiding channels. The combination holes are further arranged at different axial positions along the length of the combination post 12. The range of possible axial positions is governed by the length of the slots of the guiding channels. The axial position of each combination hole defines the combination value of the combination hole. The different possible axial positions for one of the combination holes 20*a*-20*g* is illustrated in FIGS. 4*a* and 4*b*.

The combination post 12 may be provided with additional 'dummy' holes as an additional anti-tampering measure.

To release the lock, each locking bar pin 15 of the locking bars must engage a combination hole of the combination post 12. This is achieved using an appropriately coded key, preferred embodiments of which will be described below.

Referring to FIGS. 1 and 3, the key includes coding arranged to engage the carriages 16 of the locking bars. As the key is inserted fully into the keyway, the coding slides each carriage 16 along its guiding channel until each locking bar pin is positioned above its respective combination hole. The key further engages the combination post 12 and rotor assembly 17 so that turning the key rotates the combination post 12 and rotor assembly 17. While the key is turned to an unlocking position, the locking bars are radially pushed towards the combination post 12 and the locking bar pins 15 engage the combination holes. In the event that the correct key is not used, then one or more of the locking bar pins 15 is not engaged in, the combination holes, the respective locking bar cannot move inward, and the rotor cannot turn.

Figure 2:
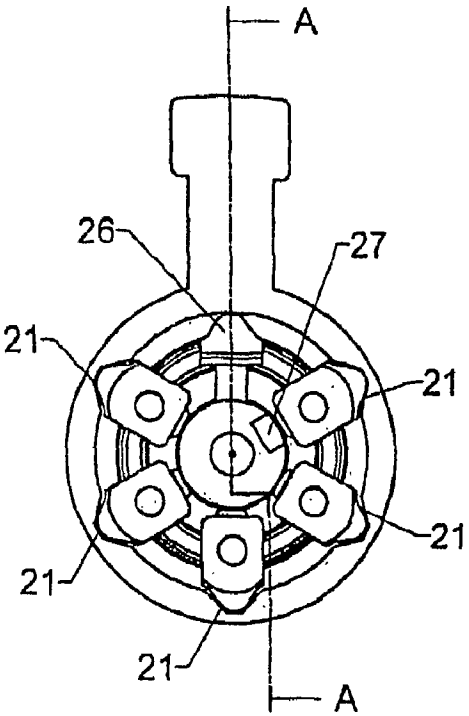
FIG. 2 is a cut-away view of a preferred embodiment of a lock from the rear of the lock.

FIG. 2 shows a view down the bore of the shell 13. The surface of the bore has a number of grooves 21 extending down the length of the bore. When a correctly coded key turns the rotor, the grooves allow the locking bars to move radially outwards and the locking bar pins 15 disengage from the combination holes. Turning the rotor further causes the locking bars to leave the grooves, thereby pushing them radially inwards and engaging the locking bar pins 15 with the combination holes.

In an alternative embodiment of the lock, the combination post 12 is provided with further combination holes which are angularly offset from the combination holes described above. This provides at least one alternative set of parallel combination values for a differently coded key. In order to unlock the lock using the alternative combination holes it is necessary that the combination post 12 rotates independently of the rotor assembly 17 so that the alternative combination holes are accessible via the slots. It will be appreciated that this alternative embodiment readily facilitates master keying of the lock. A preferred embodiment of this alternative version of the lock will now be described.

Referring to FIG. 4*a*, the combination post 12 in this embodiment has three sets of combination values, namely a central set 20, 22, a left-turn set which are offset from the central set in a clockwise direction, and a right-turn set which are offset from the central set in an anti-clockwise direction. In FIG. 3 only one of the left-turn set of combination holes 23 can be seen. Similarly, only one of the right-turn set of combination holes 24 can be seen. The combination post 12 further includes a triangular shaped recess (setting hole) 25.

A setting pin 26 is provided on the rotor assembly 17. This setting pin 26 protrudes into the triangular shaped recess 25.

The combination post 12 is rotatable independently of the rotor assembly 17. The combination post 12 is further spring biased in an axial direction. The spring bias and the setting pin 26 will cause the combination post 12 to naturally position itself into a position in which the central set of combination values are aligned with the slots of the guiding channels, as shown in FIG. 5*b*. The setting pin 26 guides the combination post 12 into this natural position in accordance with the triangular shape of the recess 25, so that it sits at the top corner of the triangle. In this position, a key having coding corresponding to the central set of combination values will unlock the lock as described before.

Figure 5A:
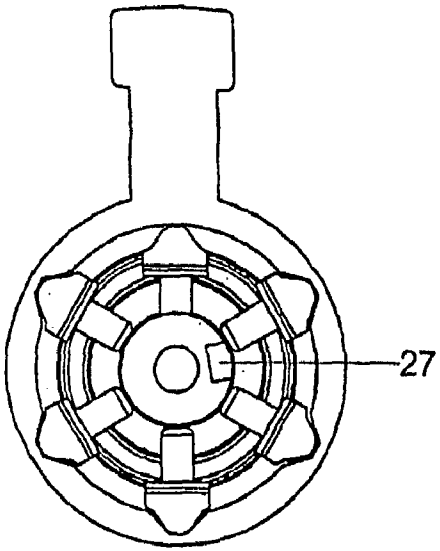
FIG. 5*a* is a view of the lock of FIG. 2 having the combination post rotated for left-turn combination values.
Figure 5D:
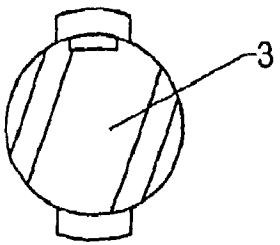
FIG. 5*d* is a view of a key having a rotator adapted to provide the combination post rotation in FIG. 5*a;*
Figure 5B:
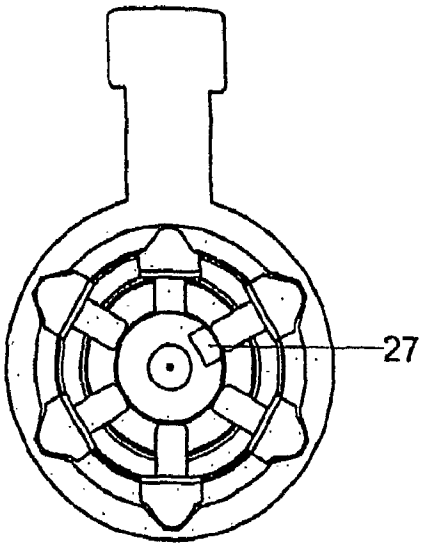
FIG. 5*b* is a view of the lock of FIG. 2 having the combination post positioned for central combination values.
Figure 5E:
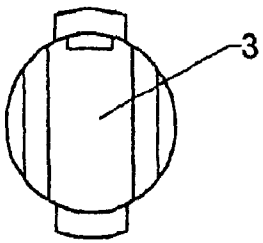
FIG. 5*e* is a view of a key having a rotator adapted to position the combination post in FIG. 5*b;*

To change the lock to the left-turn set of combination values, the combination post 12 is pushed into the lock, until the setting pin is located at the base of the triangular shaped recess, and then the combination post 12 is rotated anti-clockwise, until the setting pin is located in the right-hand corner of the recess, as shown in FIG. 5*a*. At this position the combination holes providing the left-turn set of combination values are aligned with the slots of the guiding channels. The lock can then be unlocked as before but with a key having the new applicable coding.

Figure 5C:
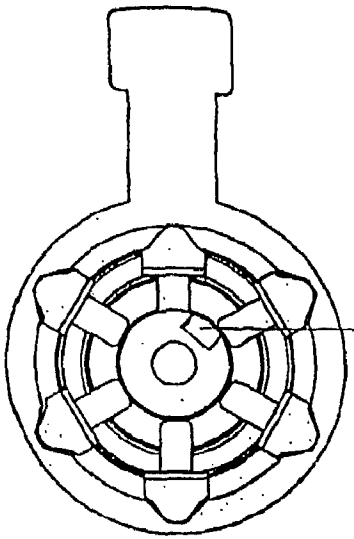
FIG. 5*c* is a view of the lock of FIG. 2 having the combination post rotated for right-turn combination values.
Figure 5F:
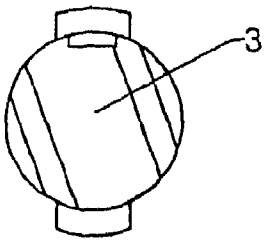
FIG. 5*f* is a view of a key having a rotator adapted to provide the combination post rotation in FIG. 5*c;*

The procedure for changing the lock to the right-turn set of combination values is substantially the same except that the combination post 12 is rotated clockwise, as shown in FIG. 5*c*.

The pushing and rotating of the combination post 12 is preferably effected by the key. In this case, the face of the combination post 12 is shaped to engage a rotator 3. The orientation of the rotator 3 dictates whether, and in which direction the combination post 12 is initially turned in order to set the appropriate combination set. The different orientations of the rotor are illustrated in FIG. 5.

A preferred embodiment of a key for operating the locks described above is shown in FIG. 1. The key includes a key head 1, a rotator 3 a retaining pin 5, a retainer sleeve 2, a cylindrical body 4, and a driver bar 7.

The cylindrical body 4 has protrusions 4*a* on its surface extending axially along the surface. The protrusions 4*a* provide the coding on the key and are positioned around the circumference of the combination cylinder 4 so that each protrusion 4*a* engages a respective carriage 16 of a locking bar. The axial lengths of each protrusion 4*a* determine how far along the guiding channels the locking bars are displaced.

The face cap 8 is shaped in order to accept the combination cylinder 4 with the protrusions 4*a*.

The protrusions 4*a* and the driver bar 7 interlock with the rotor assembly 17. This drives the rotation of the rotor assembly 17 when the key is turned.

The rotator 3 is arranged within the cylindrical body 4. The face of the rotator 3 is shaped to mate with the face of the combination post 12. The rotator 3 is arranged, in relation to the cylindrical body 4, so that, upon use of the key, the rotator 3 engages the combination post 12 before the protrusions 4*a* fully displace the locking bars. This allows for the selection of an alternative set of combination values on the combination post 12 before the locking bars are fully displaced.

The face cap 8 is shaped so that the key with the driver bar can only enter and leave the lock in a certain orientation. This ensures that the coding of the key is properly aligned with the combination values on the combination post 12 when the key is entered and that the lock is returned to its original position when the key is removed.

It is envisaged that the above embodiment may be modified in a number of notable ways. In particular, the combination post 12 could be provided with only two parallel combination values. It is also envisaged that the combination post 12 could be provided with more than three parallel combination values. The practical limitation on how many parallel combination values are provided is determined by the angular separation of the locking bars and hence the angular separation of respective combination holes of the same set, between which respective parallel combinations holes are positioned. It should be appreciated that there must be a sufficient degree of separation between combination holes of parallel combination values in order to provide distinctive parallel sets of combination values.

This is an important advantage of the inventive lock. In conventional arrangements, where all keys are operating using the same set of possible combinations—say six pins with 5 positions each—any master keying removes free combinations. In the present arrangement, sets of combinations can be truly parallel. An entirely separate key can operate at one rotation relative to the key at another rotation. Only one rotational position can be active at a time. Moreover, it need not be apparent to the lock user which alternative rotational positions are active.

Accordingly, the master key combination can be set at one rotational position without any combinational relationship or limitation being imposed by the ordinary combination.

In the above embodiment of the key, the protrusions 4*a* are of continuous length. The coding is determined by where along the length of the key a front face of the protrusion 4*a* is located, as it is this part of the protrusion 4*a* which engages the locking bar. Therefore the coding aspect of the protrusion 4*a* could be replaced by a nodule, or similar, located where that front face need be.

In another preferred embodiment, the combination post 12 is removable. This allows for the combination post 12 to be replaced, thereby changing the combination of the lock without altering the structure of the rest of the lock. In this embodiment the combination post 12 is provided with a channel 27 running to the rear end of the combination post 12, see FIG. 4*a*.

Figure 7:
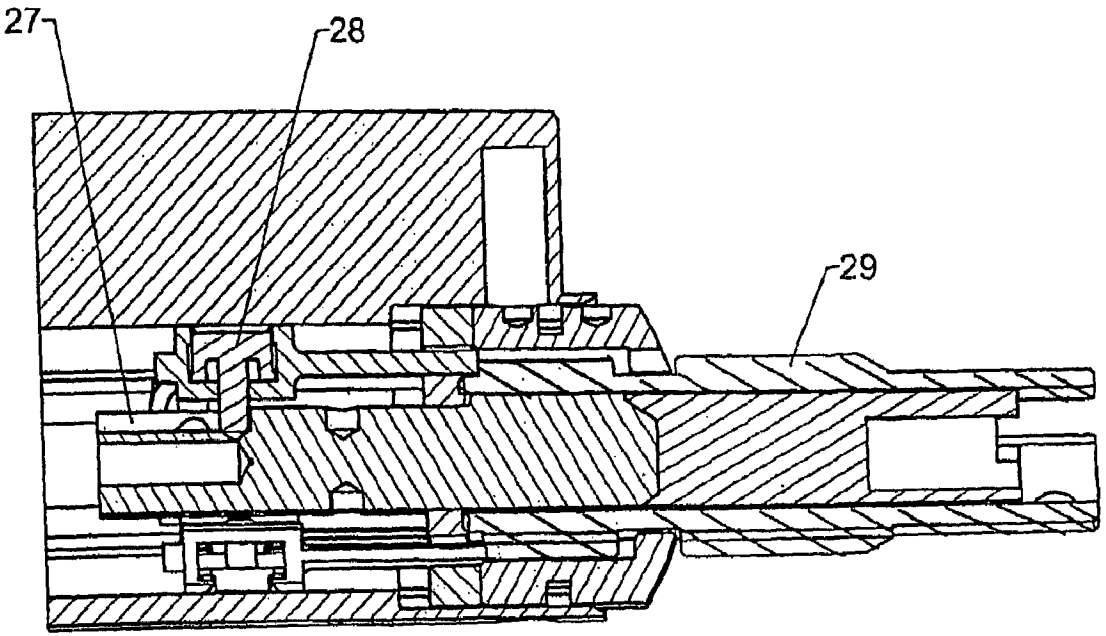
FIG. 7 is a cross-sectional view of the lock in FIG. 6 taken along lines A-A, the lock having a removal key inserted.
Figure 6:
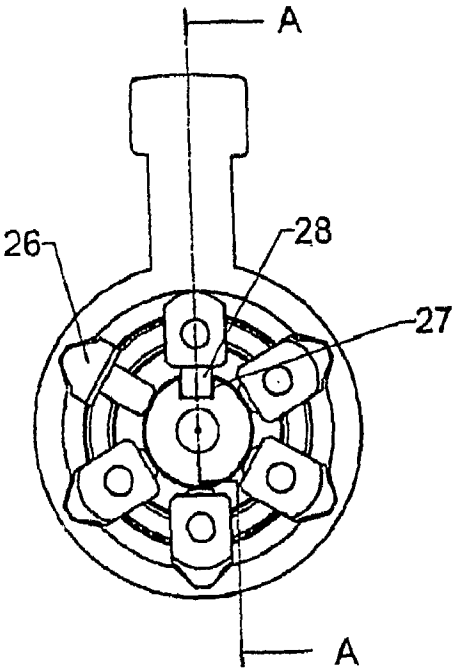
FIG. 6 is a cut away view of the lock from the rear of the lock with the rotor assembly in the removal position.

The process for removing the combination post 12 is illustrated. FIGS. 2 and 3 show the initial position of the rotor assembly 17 corresponding to the position when the key is inserted or removed from the lock. In this position the locking bar pins 15 are not engaging the combination holes and the setting pin 26 is fully engaging its recess 25. The rotor assembly 17 is rotated clockwise to a removal position. During rotation all the locking bar pins 15 and the setting pin 26 engage their respective combination holes. FIGS. 6 and 7 show the rotor assembly 17 at the removal position. At this position only locking bar 28 is radially displaced and its locking bar pin engaging the channel 27. The remainder of the locking bar pins and the setting pin 26 are not engaging their respective holes. The combination post can then simply be extracted straight out of the lock, the locking bar pin of locking bar 28 following the course of the channel 27. The combination post 12 may be extracted by simply gripping, with one's fingers, the face of the combination post and pulling, or by using an appropriate gripping tool.

A removal key 29 is preferably provided to initially position the rotor assembly 17 into the removal position. The removal key 29 is similar to the normal key but with the driver bar 8 removed. This allows the removal key 29 to be removed from the lock but retaining the rotor assembly 17 in the removal position. The combination post 12 can then be accessed for removal.

Inserting a replacement combination post 7 is essentially the reverse procedure of the above.

The removal key 29 will still require correct coding in order to turn the rotor assembly 17 to the removal position. The coding will ordinarily correspond with that of a grandmaster key so that only one removal key 29 is required in order to work with all locks.

It will be appreciated that a person wishing to change the combination of their lock only requires a new combination post 12 and appropriately coded key. It is envisaged that combination posts and keys will be supplied in the form of matching post and key sets. In the case of parallel combinations being available on the posts, a plurality of matching post and key sets could be provided with one or more master key for use with some or all of the posts.

Figure 8:
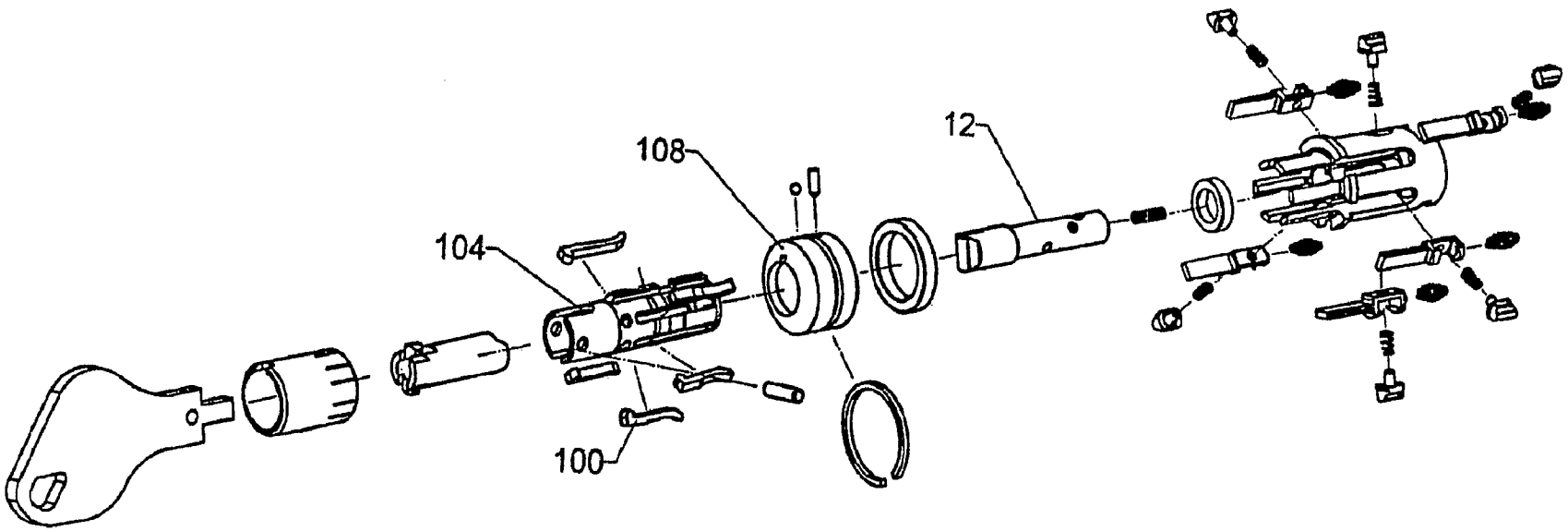
FIG. 8 is an exploded view of an alternative preferred embodiment of a lock plug and key.

In another embodiment of the lock, shown in FIG. 8, the face cap 108 has a substantially circular keyway, having a diameter proportionate to the diameter of the combination cylinder 4 of the key. In this embodiment the face cap 108 will not accept the combination cylinder 4 having coded protrusions 4*a* in the key described before.

FIG. 8 further shows an alternative key structure which is adapted to suit this type of lock. In this embodiment, the cylindrical body 104 is provided with slots where the coding is required. Within each slot is arranged an actuator 100. Each actuator 100 is biased to extend within the centre of the cylindrical body 104 and is shaped to provide the necessary coding.

Figure 9:
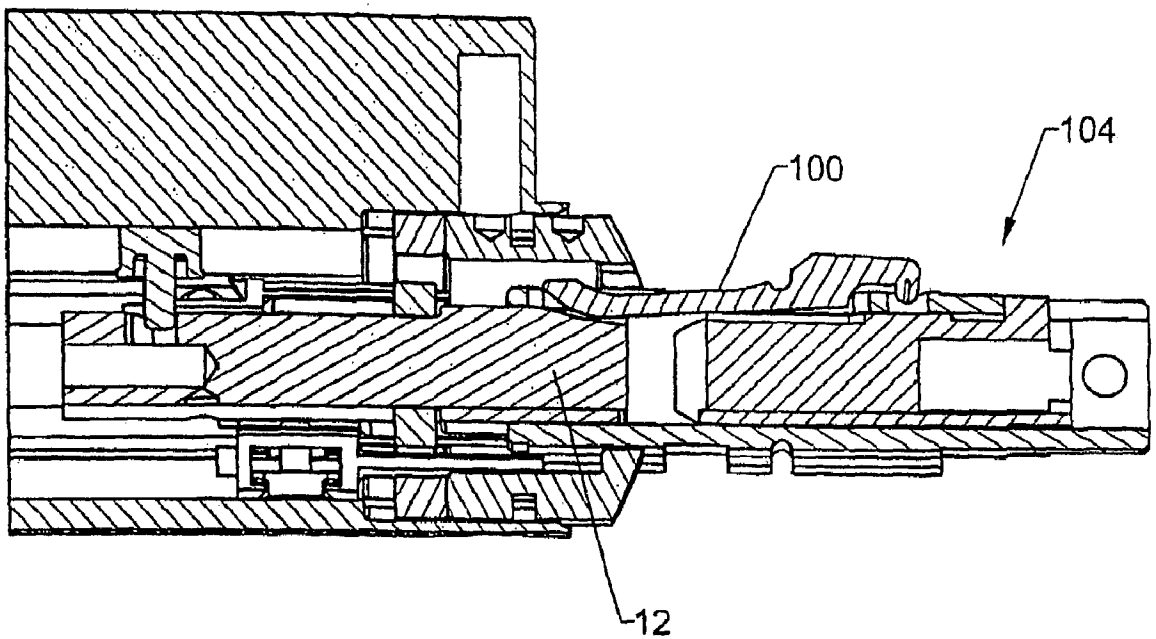
FIG. 9 is a cross-sectional view of the lock of FIG. 2 taken along lines A-A, the lock having an alternative embodiment of a key partially inserted.

FIG. 9 shows a key having an actuator 100 entering the lock, the combination post 12 enters the cylindrical body 104. The combination post 12 engages the actuator 100 and, pushes it out through the slot of in cylindrical body 104. As the actuator 100 moves, the respective coding is exposed and engages the locking bar in the normal manner.

It will be appreciated that providing the lock with such a face cap 108 will add further security advantages to the lock. The face cap 108 will prevent anyone from looking into the lock and viewing the outer mechanism. Furthermore, the face cap 108 will make it extremely difficult for a person to access and tamper with the lock mechanism.

It is envisaged that the removal key could be based upon this alternative key structure for the lock shown in FIG. 1.

It is further envisaged that a key and/or removal key could be a hybrid of the alternative key structures. In other words, a key or removal key may be provided with a combination of protrusions and actuators. For example, a key may have one actuator, as discussed above, and the remaining coding positions as simple protrusions. It will be appreciated that where such a hybrid key or removal key is used the face cap will need to be shaped to at least accept such a key or removal key. This hybrid approach opens up the possibility of having key profiles. For example, a lock may have a combination post with a certain set of combination values and a face cap having a key way shaped to accept keys with a particular number of protrusions in particular positions. A number of hybrid keys may be appropriately coded to unlock such a lock, however, only an appropriately coded key having protrusions in the correct positions would be able to enter the key way.

Although only preferred embodiments of the invention have been described, it is noted that the invention may be embodied with modified features and additional features which would be apparent to those skilled in the art.

What I claim is:

1. A cylinder lock, including: a housing having a cylindrical bore therein; a rotor assembly rotatably mounted within said bore; a plurality of locking bars arranged on said rotor assembly, each locking bar including a locking bar pin directed radially inward towards the axis of said rotor assembly, wherein each locking bar is displaceable on the rotor assembly in a direction substantially parallel with said axis, and each locking bar is displaceable in a radial direction with respect to said axis; and a combination post arranged along said axis, said combination post having a plurality of combination holes formed thereon; wherein each of said locking bars is adapted to be displaced by a coded key, in said substantially parallel direction, to a position in which the locking bar pin of each said locking bars is directed towards a respective combination hole; said rotor assembly is adapted to be rotated by said key to an unlocking position, wherein at various rotational positions each said locking bar is radially displaced towards said axis, thereby engaging each said locking bar pin with a respective combination hole, so as to permit rotation of said rotor assembly within said bore.

2. The cylindrical lock according to claim 1, wherein said lock is adapted to allow said key to be inserted into and removed from said lock only when said rotor assembly is in a first rotational position.

3. The cylinder lock according to claim 1, wherein said combination post arranged such as to be rotatable independent of said rotor assembly.

4. The cylinder lock according to claim 3, wherein said combination post is adapted for engagement by said key in order to facilitate rotation of said combination post by said key.

5. The cylinder lock according to claim 4, wherein said combination post includes additional combination holes angularly offset from said combination holes, said additional combination holes defining a parallel coding for said combination post.

6. The cylinder lock according to claim 5, wherein the combination post is adapted to be rotated with respect to said rotor assembly to a position where said parallel coding is aligned with said locking bars, whereby the lock can be operated by a key coded according to said parallel coding.

7. The cylinder lock according to claim 6, wherein said parallel coding is a master key coding.

8. The cylinder lock according to claim 1, wherein said combination post is adapted to be removable from said lock.

9. The cylinder lock according to claim 8, including means for preventing said combination post from being removed at a first rotational position of said rotor assembly.

10. The cylinder lock according to claim 9, wherein said preventing means includes a setting pin having a fixed position on said rotor assembly with respect to said substantially parallel direction and is radially directed towards a setting hole arranged on said combination post, said setting pin being displaceable in a radial direction with respect to said axis, wherein said lock is adapted such that in said first rotational position of said rotor assembly said setting pin is displaced and engages said setting hole.

11. The cylinder lock according to claim 9, wherein said combination post is adapted to be removable at a second rotational position of said rotor assembly.

12. The cylinder lock according to claim 11 in combination with an appropriately coded removal key for facilitating rotation of the combination post and the rotor assembly to said second rotational position in order to remove the combination post, said removal key being adapted to allow said removal key to be inserted into and removed from said lock in a first and at least a second rotational orientation, said first and second rotational orientation corresponding with said first and second rotational positions of said rotor assembly respectively.

13. The cylinder lock according to claim 12, wherein said combination post includes a removal channel running to the rear of said combination post, the removal key is appropriately coded so that upon entry of the removal key in the first rotational orientation a first locking bar of said plurality of locking bars is displaced, in said substantially parallel direction, to a position in which the locking bar pin of said first locking bar is directed towards said channel, wherein said lock is adapted so that when said removal key is turned to the second rotational orientation, whereby the rotor assembly is in said second rotational position, said first locking bar is radially displaced, so that the respective locking bar pin engages said channel, and the remainder of the pins of the lock are not in engagement with the combination post.

14. A removal key structure, including: a cylindrical body having radially extending projections arranged thereon; and a rotator arranged within said cylindrical body; said removal key adapted to cooperate with a cylinder lock according to claim 11; wherein said projections are appropriately shaped and positioned such that, upon insertion of said removal key in a first rotational orientation of said cylindrical body into said lock when the rotor assembly is in a first rotational position, the locking bars are engaged and displaced by said projections, in said substantially parallel direction, to positions in which the locking bar pin of each said locking bar is directed towards a respectively associated one of said combination holes; said projections being further adapted to engage said rotor assembly in a manner whereby turning the removal key will cause the rotor assembly to rotate; wherein said rotator is adapted to engage the combination post in a manner whereby turning said removal key will cause the combination post to rotate; and wherein said key is adapted to be inserted into and removed from said lock in said first and at least a second rotational orientation of said cylindrical body, said first and second rotational orientations corresponding respectively to said first and second rotational positions of the rotor assembly.

15. The removal key of claim 14, wherein the combination post of the lock includes a removal channel running to the rear of said combination post, a first of said projections is appropriately shaped and positioned to engage and displace a first of said plurality of locking bars, in said substantially parallel direction, to a position in which the locking bar pin of said first locking bar is directed towards said channel upon entry of said removal key into said lock in said first rotational orientation of said cylindrical body.

16. The removal key according to claim 14, wherein said projections are elongated in a direction running along the length of the cylindrical body.

17. The removal key according to claim 14 wherein at least one of said projections is replaced by an actuator member having a coded portion, said actuator member being normally biased wherein said coded portion lies substantially within the cylindrical body, wherein, upon insertion of the removal key into the lock, part of the lock engages the actuator member, causing the coded portion to project from the cylindrical body and engage a respective locking bar.

18. The removal key according to claim 17, wherein the part of the lock which engages the actuator member is the combination post.

19. The cylinder lock according to claim 8, wherein said lock is adapted to accept a replacement combination post when the combination post is removed from the lock.

20. A combination post and key set for a cylinder lock according to claim 19, said set including at least one combination post and at least one appropriately coded key, wherein said at least one combination post is a replacement combination post.

21. A key structure, including: a cylindrical body having radially extending projections arranged thereon; and a rotator arranged within said cylindrical body; said key being adapted to cooperate with a cylinder lock according to claim 1; wherein said projections are appropriately shaped and positioned whereby, upon insertion of said key into said lock, the locking bars are engaged and displaced by said projections, in said substantially parallel direction, to positions in which the locking bar pin of each said locking bar is directed towards a respectively associated one of said combination holes; said projections being further adapted to engage said rotor assembly in a manner whereby turning said key will cause the rotor assembly to rotate; and wherein said rotator is adapted to engage the combination post in a manner whereby turning said key will cause the combination post to rotate.

22. The key according to claim 21, wherein said key is adapted to be inserted into and removed from said lock in only one rotational orientation of said cylindrical body and when said rotor assembly is in a first rotational position.

23. The key according to claim 21, wherein the combination post of the lock includes parallel coding, said rotator being further adapted to rotate said combination post, during insertion of the key into the lock, wherein upon full insertion of the key into the lock the parallel coding is in alignment with the locking bar pins of the locking bars.

24. The key according to claim 23, wherein said key is a master key.

25. The key according to claim 21, wherein said projections are elongated in a direction generally parallel to the length of the cylindrical body.

26. The key according to claim 21, wherein at least one of said projections is replaced by an actuator member having a coded portion, said actuator member being normally biased wherein said coded portion lies substantially within the cylindrical body, wherein, upon insertion of the key into the lock, part of the lock engages the actuator member, causing the coded portion to project from the cylindrical body and engage a respective locking bar.

27. The key according to claim 26, wherein the part of the lock which engages the actuator member is the combination post.

28. A cylinder lock, including: a housing having a cylindrical bore therein; a rotor assembly rotatably mounted within said bore; and a plurality of locking bars arranged on said rotor assembly, each locking bar including a locking bar pin directed radially inward towards the axis of said rotor assembly, wherein each locking bar is displaceable on the rotor assembly in a direction substantially parallel with said axis, and each locking bar is displaceable in a radial direction with respect to said axis; said lock being adapted to accept a combination post arranged along said axis, said combination post having a plurality of combination holes formed thereon; wherein each of said locking bars is adapted to be displaced by a coded key, in said substantially parallel direction, to a position in which the locking bar pin of each said locking bars is directed towards a respective combination hole; said rotor assembly is adapted to be rotated by said key to an unlocking position, wherein at various rotational positions each said locking bar is radially displaced towards said axis, thereby engaging each said locking bar pin with a respective combination hole, so as to permit rotation of said rotor assembly within said bore.

29. The cylinder lock according to claim 28, wherein said lock is adapted to allow said key to be inserted into and removed from said lock only when said rotor assembly is in a first rotational position.

30. The cylinder lock according to claim 28, wherein said combination post arranged such as to be rotatable independent of said rotor assembly.

31. The cylinder lock according to claim 30, wherein said combination post is adapted for engagement by said key in order to facilitate rotation of said combination post by said key.

32. The cylinder lock according to claim 31, wherein said combination post includes additional combination holes angularly offset from said combination holes, said additional combination holes defining a parallel coding for said combination post.

33. The cylinder lock according to claim 32, wherein the combination post is adapted to be rotated with respect to said rotor assembly to a position where said parallel coding is aligned with said locking bars, whereby the lock can be operated by a key coded according to said parallel coding.

34. The cylinder lock according to claim 33, wherein said parallel coding is a master key coding.

35. The cylinder lock according to claim 28, wherein said combination post is adapted to be removable from said lock.

36. The cylinder lock according to claim 35, including means for preventing said combination post from being removed at a first rotational position of said rotor assembly.

37. The cylinder lock according to claim 36, wherein said preventing means includes a setting pin having a fixed position on said rotor assembly with respect to said substantially parallel direction and is radially directed towards a setting hole arranged on said combination post, said setting pin being displaceable in a radial direction with respect to said axis, wherein said lock is adapted such that in said first rotational position of said rotor assembly said setting pin is displaced and engages said setting hole.

38. The cylinder lock according to claim 36, wherein said combination post is adapted to be removable at a second rotational position of said rotor assembly.

39. The cylinder lock according to claim 38 in combination with an appropriately coded removal key for facilitating rotation of the combination post and the rotor assembly to said second rotational position in order to remove the combination post, said removal key being adapted to allow said removal key to be inserted into and removed from said lock in a first and at least a second rotational orientation, said first and second rotational orientation corresponding with said first and second rotational positions of said rotor assembly respectively.

40. The cylinder lock according to claim 39, wherein said combination post includes a removal channel running to the rear of said combination post, the removal key is appropriately coded so that upon entry of the removal key in the first rotational orientation a first locking bar of said plurality of locking bars is displaced, in said substantially parallel direction, to a position in which the locking bar pin of said first locking bar is directed towards said channel, wherein said lock is adapted so that when said removal key is turned to the second rotational orientation, whereby the rotor assembly is in said second rotational position, said first locking bar is radially displaced, so that the respective locking bar pin engages said channel, and the remainder of the pins of the lock are not in engagement with the combination post.

41. A removal key structure, including: a cylindrical body having radially extending projections arranged thereon; and a rotator arranged within said cylindrical body; said removal key adapted to cooperate with a cylinder lock according to claim 38; wherein said projections are appropriately shaped and positioned such that, upon insertion of said removal key in a first rotational orientation of said cylindrical body into said lock when the rotor assembly is in a first rotational position, the locking bars are engaged and displaced by said projections, in said substantially parallel direction, to positions in which the locking bar pin of each said locking bar is directed towards a respectively associated one of said combination holes; said projections being further adapted to engage said rotor assembly in a manner whereby turning the removal key will cause the rotor assembly to rotate; wherein said rotator is adapted to engage the combination post in a manner whereby turning said removal key will cause the combination post to rotate; and wherein said key is adapted to be inserted into and removed from said lock in said first and at least a second rotational orientation of said cylindrical body, said first and second rotational orientations corresponding respectively to said first and second rotational positions of the rotor assembly.

42. The removal key of claim 41, wherein the combination post of the lock includes a removal channel running to the rear of said combination post, a first of said projections is appropriately shaped and positioned to engage and displace a first of said plurality of locking bars, in said substantially parallel direction, to a position in which the locking bar pin of said first locking bar is directed towards said channel upon entry of said removal key into said lock in said first rotational orientation of said cylindrical body.

43. The removal key according to claim 41, wherein said projections are elongated in a direction running along the length of the cylindrical body.

44. The removal key according to claim 41 wherein at least one of said projections is replaced by an actuator member having a coded portion, said actuator member being normally biased wherein said coded portion lies substantially within the cylindrical body, wherein, upon insertion of the removal key into the lock, part of the lock engages the actuator member, causing the coded portion to project from the cylindrical body and engage a respective locking bar.

45. The removal key according to claim 44, wherein the part of the lock which engages the actuator member is the combination post.

46. A combination post and key set for a cylinder lock according to claim 28, said set including at least one combination post and at least one appropriately coded key.

47. The combination post and key set according to claim 46, wherein said at least one combination post of said set includes parallel coding, said set further including at least one key appropriately coded for said parallel coding.

48. The combination post and key set according to claim 46, wherein at least two combination posts are provided with the same parallel coding, said set further including a master key appropriately coded for said same parallel coding.

49. The combination post and key set according to of claim 46, said set further including a removal key.

50. A key structure, including: a cylindrical body having radially extending projections arranged thereon; and a rotator arranged within said cylindrical body; said key being adapted to cooperate with a cylinder lock according to claim 28; wherein said projections are appropriately shaped and positioned whereby, upon insertion of said key into said lock, the locking bars are engaged and displaced by said projections, in said substantially parallel direction, to positions in which the locking bar pin of each said locking bar is directed towards a respectively associated one of said combination holes; said projections being further adapted to engage said rotor assembly in a manner whereby turning said key will cause the rotor assembly to rotate; and wherein said rotator is adapted to engage the combination post in a manner whereby turning said key will cause the combination post to rotate.

51. The key according to claim 50, wherein said key is adapted to be inserted into and removed from said lock in only one rotational orientation of said cylindrical body and when said rotor assembly is in a first rotational position.

52. The key according to claim 50, wherein the combination post of the lock includes parallel coding, said rotator being further adapted to rotate said combination post, during insertion of the key into the lock, wherein upon full insertion of the key into the lock the parallel coding is in alignment with the locking bar pins of the locking bars.

53. The key according to claim 52, wherein said key is a master key.

54. The key according to claim 50, wherein said projections are elongated in a direction generally parallel to the length of the cylindrical body.

55. The key according to claim 50, wherein at least one of said projections is replaced by an actuator member having a coded portion, said actuator member being normally biased wherein said coded portion lies substantially within the cylindrical body, wherein, upon insertion of the key into the lock, part of the lock engages the actuator member, causing the coded portion to project from the cylindrical body and engage a respective locking bar.

56. The key according to claim 55, wherein the part of the lock which engages the actuator member is the combination post.

* * * * *